US005826881A

United States Patent [19]

Osterman et al.

[11] Patent Number: 5,826,881

[45] Date of Patent: Oct. 27, 1998

[54] DISCONNECTION WORD GAME

[76] Inventors: Dorothy B. Osterman, 2885 Columbia Rd.; Marlene Dunivan, 2785 Columbia Rd., both of Gordonsville, Va. 22942; Dawn O. Hierholzer, 5252 Ellisville Dr., Louisa, Va. 23093

[21] Appl. No.: 754,899

[22] Filed: Nov. 22, 1996

[51] Int. Cl.[6] ..... A63F 3/00

[52] U.S. Cl. ..... 273/299; 273/272; 434/167

[58] Field of Search ..... 273/272, 273, 273/299, 302; 434/167, 168

[56] References Cited

U.S. PATENT DOCUMENTS 4,592,553 6/1986 Mammen et al. ..... 273/272
4,911,452 3/1990 Marchese ..... 273/272
4,928,976 5/1990 Vano et al. ..... 273/272
5,271,623 12/1993 Torres ..... 273/272

*Primary Examiner*—William M. Pierce
*Attorney, Agent, or Firm*—John P. Halvonik

[57] ABSTRACT

A word association game requiring players to match words that are listed on discs that are drawn from a bag is shown and described. The players are dealt subject cards which are then placed in a designated area on their game board. Each player tries to match as many of his discs with a particular category that is found on his board. After the initial round, action cards drawn by the players indicate further actions that the players must take. When a player has completed all of the spaces on his board, he declares his accomplishment to the other players and one half of the other players must agree with his disc associations in order for the player to be declared the winner.

1 Claim, 1 Drawing Sheet

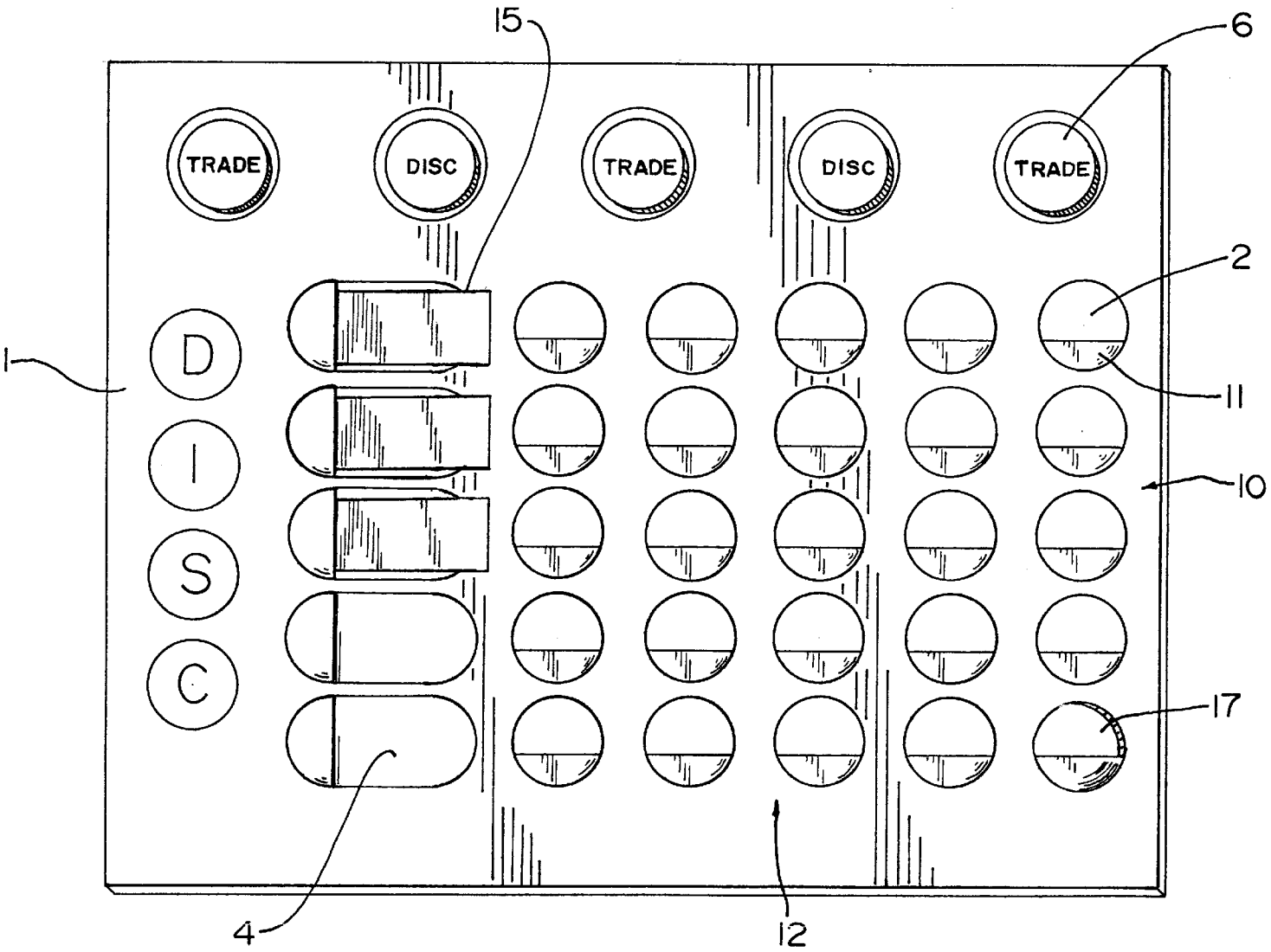
TRADE
DISC
TRADE
DISC
TRADE
D
I
S
C
1
2
4
6
10
11
12
15
17

DISCONNECTION WORD GAME

BACKGROUND AND FIELD OF THE INVENTION

The invention relates to the field of board games and, in particular, to a word association game that requires players to make associations between words that they randomly choose from a group of unused tokens and word categories that are distributed at the start of the game and are indicated on each player's game board.

PRIOR ART

While there are word games that are played on boards, none that applicant is aware of, use the same word association method in order to allow a word to be played onto the board.

SUMMARY OF THE INVENTION

The invention is a word association game requiring players to match words that are listed on one side of tokens or discs which players draw from a bag or other source of discs with subject cards dealt to players at the start of the game. Each of the players has a game board having a series of rows and columns for the placement of the discs and subject cards. At the start of the game, the players are dealt subject cards which are then placed in a designated area on their game board. Initially, each player draws 5 discs from a bag or other collection point and tries to match as many of his discs with a particular category that is found on his board. After the initial round, action cards drawn by the players indicate further actions that the players must take. A player can decide to designate up to 5 of his link discs as trading discs by placing them above the playing board positioning the discs so other players can readily read them. When a player has completed all of the spaces on his board, he declares his accomplishment to the other players and one half of the other players must agree with his disc associations in order for the player to be declared the winner.

An objective of the invention is to provide a word association game that uses specific words on discs drawn by the players to link subject categories dealt to each player and placed on the player's game board. The invention also provides entertainment, a chance for players to use there imagination, and be creative in their thinking. The player learns new and interesting information and is challenged to recall facts previously learned but not recently used. The player gets to "show off" his knowledge on particular subjects but, most of all, the invention provides the game players with fun.

Other objects of the invention will become apparent to those skilled in the art once the invention is shown and described.

DESCRIPTION OF FIGURES

FIG. 1 Overall construction of game board.

DESCRIPTION OF THE PREFERRED EMBODIMENT

The game board as originally designed is shown in FIG. 1. It is preferred that the game stay in its original design but other configurations are possible without varying from the spirit of the invention. Upon the surface 1 of the board are a series of spaces or slots 2 that are arranged in rows 10 and columns 12. The slots may be of any type that can hold the tokens or discs that are part of the game.

The slots are, preferably, in a 5×5 configuration but other configurations are possible. There is no requirement that the number of rows must equal the number of columns, although in a 5×5 board, of course, the number of rows does equal the number of columns. The board may be constructed with an additional column of slots 4 along one side in order to hold the subject cards. Elliptical pockets 11 that resemble a half-moon may be attached in connection with each of the spaces in order to provide a convenient method to hold the discs. These may be affixed to the board in a 5×5 configuration or some other configuration. Such elliptical pieces should be just above the surface of the board so as to create a slot that can hold the disc 17. The game may vary in the number of players, the configuration of the board and the number of discs and cards that are used.

The primary objective of the game is to completely fill all the spaces on your board with discs selected from the bag or another source. The spaces 4 at the left side of the board are filled with subject cards 15, a set of cards having different subjects (e.g. "baseball") that are dealt to each player at the start of the game. The players try to match the words on discs they draw with those subjects on the left side of the board. The discs 17 are placed into the spaces or slots in that row that corresponds to the subject see FIG. 1. There are bonus discs (e.g. wild cards) that can be used in very special circumstances to assist in completing the board. There are cards known as action cards that instruct the players on how to proceed.

A player is selected to go first (this may be by rolling the die) and the other players will play in a clockwise order one at a time thereafter. The player selected to go first deals each of the players six (6) subject cards. The subject cards may be distributed by dealing, or in some other manner that insures they will be distributed randomly. Each of the players keeps five (5) of the subject cards and returns the other to the box or other place where the cards are stored. After dealing the subject cards to each player, the play begins.

In the first round only, the dealer as well as all other players draw five (5) discs from out of the bag or other source. These discs are known as link discs. Each of the discs has a word or words on them and the word or words may correspond to one or more of the subject categories listed on the subject cards. The discs are placed in a bag or similar article to hold them and keep their information secret before selection. At this time, if a player draws a bonus disc, it must be placed back in the bag without being replaced. After the first round, if a player draws a bonus disc, it may be used either to 1) fill the last space on his board if he has one space remaining to fill, or 2) if the action card drawn states, for example: "Draw 3 Discs—Use Any Bonus Disc Drawn as a Wild Card", he uses the disc where he wants and keeps the action card alongside his board for the entire game. The number of bonus discs that may be drawn can, of course, vary.

The first player then decides if he can place any of these 5 link discs on his board by matching the word on the disc with one of the subjects on his board. Of course, for each subject he can only play 5 discs that match the subject because there are only 5 spaces in that row. The other discs played on the board must match the other subjects, of course. If he can't play a disc or discs, the player either returns the disc to the bag or places it in a position to designate it as a trade disc. A player may designate up to 5 discs as "Trade Discs." "Trade discs" are simply those link discs that players may designate for trading with another player who wants to exchange one trade disc for another. The player may indicate a trade disc or discs by placing them in a designated manner, such as in position 6 shown in FIG. 1, to show his intent to trade them. A player may desigate up to five trade discs in this manner. While playing the game, a player may realize he has designated Trade Discs that are not being sought by other players. He can then choose to exchange his Trade Discs in the following manner: During his turn, after drawing an Action Card, if it tells him to draw a link disc or discs, he can use the disc(s) to fill a link disc space or he can use a disc to replace a Trade Disc, 1 for 1. Any disc not used, then goes back into the disc bag. The number of discs he can use for any purpose is predetermined by the number of discs the Action Card authorized him to draw.

After all players have taken their turn and disposed of the 5 discs they selected, the first player then draws one action card and follows its instructions. Action cards will give the player instructions on how to proceed (e.g. "Draw 3 link discs" or "Draw 2 link discs and draw another action card" or "Lose your turn"). Other action cards may give you the opportunity to exchange a trade disc with other players to assist you in completing your board. Such trades may be mandatory (i.e. the other player has to trade with the player holding the action card) or may be optional according to what the action card states. When the first player has done as the action card has instructed, play passes to the next player who chooses an action card. After the first round, the players do not automatically draw 5 discs each turn, but rather they each draw an action card and follows its instructions.

The player who has filled his board with discs will declare this to the other players and the play stops. In order to win the game, one-half of the other players then must agree that all of the word associations are valid. The player is allowed to try to convince the group of the validity of any of his discs. If one-half of the players believe that one, or more, of the discs do not relate to the given subject or subjects, the player must return the entire row of link discs to the disc bag. That is, he must return all the discs in the row that has a disputed disc. In one or more rows where one half of the players agree a disc association is unacceptable all the discs in the disputed row(s) must be returned to the disc bag.

The play continues until one player completes his or her board to the satisfaction of at least one half of the other players.

I claim:

1. A method for playing a word association game among 2 or more players, said method comprising the following steps:

a. allocating to each player a game board, said game board having a series of rows and columns, each of said rows having a subject space at one side thereof;

b. providing subject cards to each of said players; each of said cards having a subject word indicated on said card, said subject word chosen from a group of such subject words;

c. each said player associating each of said subject spaces on his said game board with a subject card;

d. each of said players drawing link disks from a group of link discs, each of said link disks having at least one word on said link disk;

e. each player associating one or more of said link discs with a subject card on said game board by placing said link discs onto an open space in one of said rows that is aligned with a given subject card;

f. further play comprising each of said players taking a turn in an assigned order;

g. each of said turns comprising: picking an action card from a group of said action cards and doing such action, if possible; said action cards having commands including the commands of: losing a turn, drawing one or more action cards, picking link disks from said group of link disks and associating said link disks with said subject cards in the manner of step e, and indicating a mandatory trade;

h. during the game allowing each player the option of designating certain unplayed link discs to be played in front of him and designated a trade disk; said trade discs may be exchanged with those link disks of another player at the option of each player; said trade disks must be exchanged with those of another player at the option of the player designating said trade disks if so indicated by an action card drawn by a player with designated trade disks;

i. declaring a winner when one player has filled his said game board with link disks and at least one half of the other players agreeing with each and every word association formed between said link disks and said subject words; in the event that at least one half of the players dispute a given association said player must remove all of those link disks in that row that contains said disputed association and return said link disks to said group of said link disks.

* * * * *